US005240176A

United States Patent [19]

Akers

[11] Patent Number: 5,240,176

[45] Date of Patent: Aug. 31, 1993

[54] PAPERBOARD HOSPITAL WASTE CONTAINER

[75] Inventor: John E. Akers, Mason, Mich.

[73] Assignee: International Paper Company, Purchase, N.Y.

[21] Appl. No.: 925,680

[22] Filed: Aug. 7, 1992

[51] Int. Cl.[5] ..... B65D 5/10

[52] U.S. Cl. ..... 229/155; 206/366; 220/908; 229/168

[58] Field of Search ..... 206/366; 220/403, 410, 220/416, 908; 229/157, 167, 168

[56] References Cited

U.S. PATENT DOCUMENTS

| | | | |
|---|---|---|---|
| 1,443,279 | 1/1923 | Schindler . | |
| 1,895,768 | 1/1933 | Ottinger . | |
| 2,004,358 | 6/1935 | Wolf . | |
| 2,321,145 | 6/1943 | Jones . | |
| 2,465,324 | 3/1949 | De Mian . | |
| 2,555,581 | 6/1951 | Dunning | 229/168 |
| 2,885,140 | 5/1959 | Guyer . | |
| 3,014,635 | 12/1961 | Mairs et al. | 229/167 |
| 3,090,539 | 5/1963 | Dorofachuk . | |
| 3,203,613 | 8/1965 | Stowe | 229/168 |
| 3,935,992 | 2/1976 | Uriu | 229/157 |
| 3,998,379 | 12/1976 | Myers et al. . | |
| 4,121,755 | 10/1978 | Meseke et al. | 206/366 |
| 4,163,492 | 8/1979 | Rella . | |
| 4,315,592 | 2/1982 | Smith . | |
| 4,534,489 | 8/1985 | Bartlett . | |
| 4,662,559 | 5/1987 | Uryu | 229/157 |
| 4,674,676 | 6/1987 | Sandel et al. . | |
| 4,722,472 | 2/1988 | Bruno . | |
| 4,826,073 | 5/1989 | Bruno . | |
| 4,863,052 | 9/1989 | Lambert . | |
| 4,869,366 | 9/1989 | Bruno . | |
| 4,886,164 | 12/1989 | Stein et al. | 206/366 |
| 4,978,028 | 12/1990 | George . | |
| 5,096,114 | 3/1992 | Higginbotham | 206/366 |

FOREIGN PATENT DOCUMENTS

| | | | |
|---|---|---|---|
| 1100400 | 1/1968 | United Kingdom | 220/416 |
| 1207421 | 9/1970 | United Kingdom | 220/410 |

*Primary Examiner*—Gary E. Elkins
*Attorney, Agent, or Firm*—Michael J. Doyle

[57] ABSTRACT

A hospital waste receptacle is formed of two unitary blanks of corrugated paperboard, one blank forming a unitary outer container and the other blank forming a unitary inner container. The blank for the inner container may assume either of two forms to yield an inner container whose side walls either contact the side walls of the outer container, or alternatively, are spaced from them. The inner container is shorter than the outer container. The outer container has two main top closure panels, opposite to each other, with the inner top closure panel having a central opening for disposition of hospital waste therethrough. The outer top closure panel carries a pair of latches to secure it closed when the receptacle is full. The outer top closure panel also carries a pull out handle to assist in transporting the filled receptacle. In a modification, the top pull handle is omitted and opposite ends of the container provided with hand holes. A pair of spaced hollow beams extend along the sides of the container.

22 Claims, 10 Drawing Sheets

FIG. 6
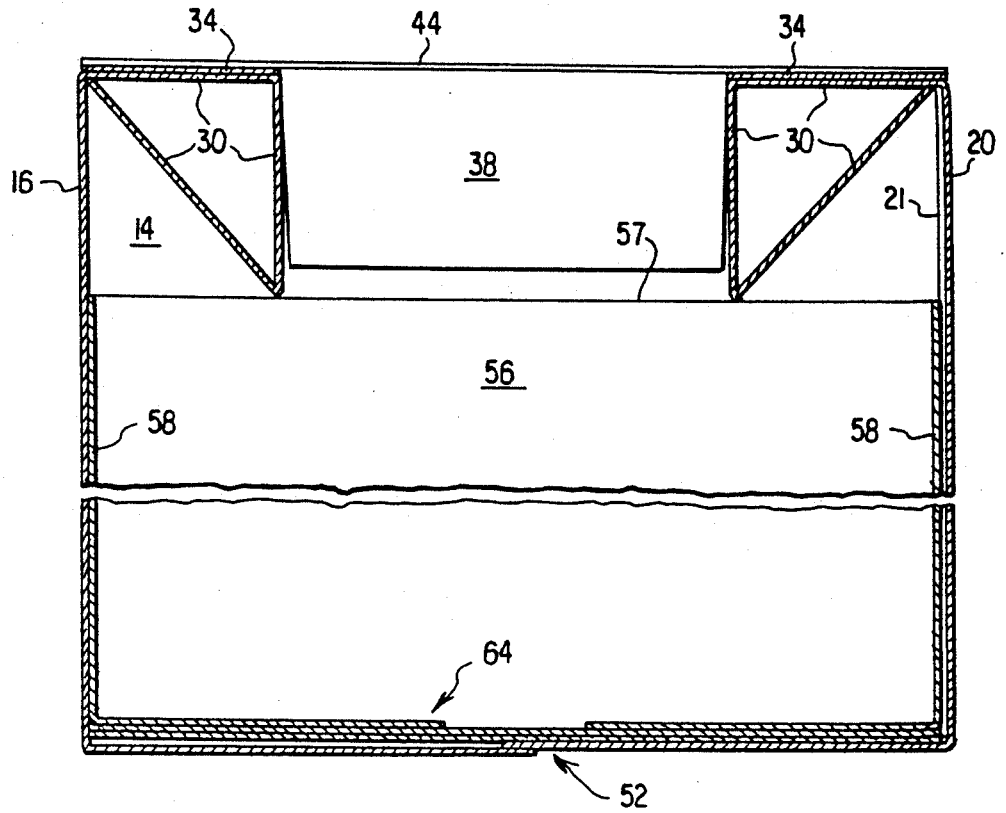
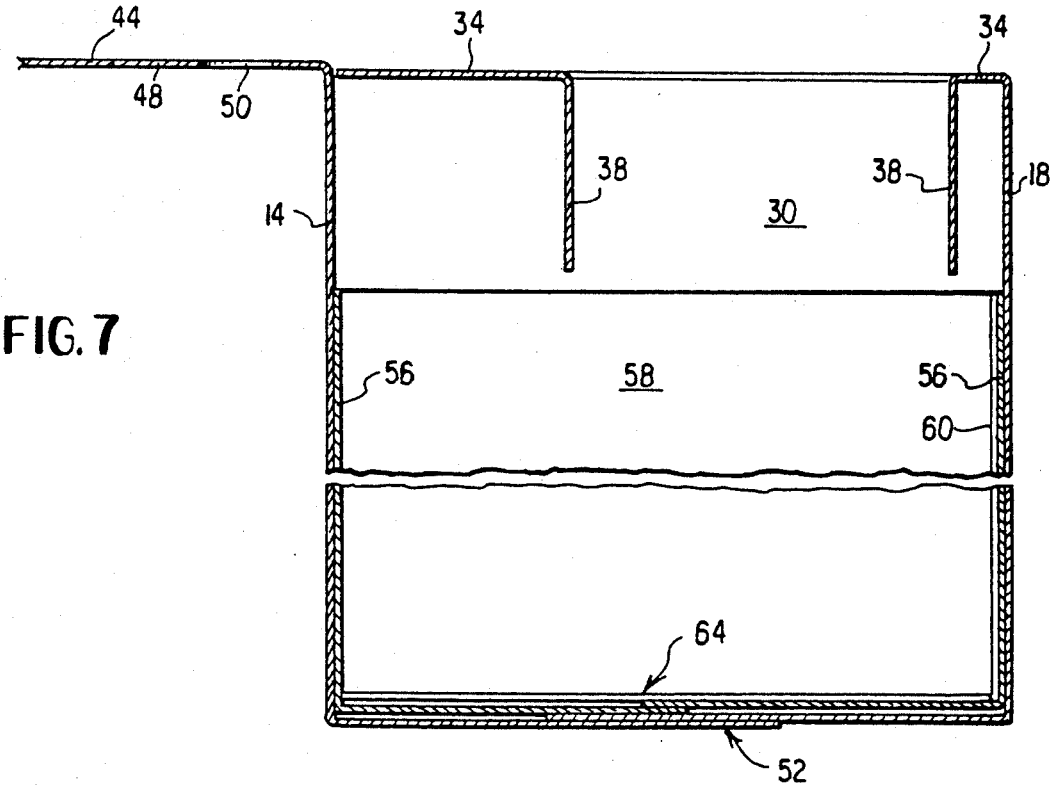
FIG. 7

PAPERBOARD HOSPITAL WASTE CONTAINER

BACKGROUND OF THE INVENTION

This invention relates to containers and more particularly to containers fashioned from paperboard or corrugated paperboard for holding hospital waste. Hospital waste is preferably deposited in hospitals in special containers which, after they are full, must often be disposed of in accordance with state or federal environmental guidelines. The handling of such refuse is desirably such that those persons handling filled waste containers do not come in contact with the hospital waste itself.

The prior art is aware of constructions for hospital waste containers, as may be seen by reference to U.S. Pat. Nos. 4,863,052 issued to Lambert, 4,869,366 issued to Bruno, and 4,978,028 issued to George et al.

SUMMARY OF THE INVENTION

According to the practice of this invention, a hospital waste container, fashioned from corrugated paperboard or other stiff, foldable and resilient sheet material the like is provided with an outer top cover panel which is swung over the mouth of the filled container and latched into place preferably so as to prevent unlatching. This outer panel is provided with a pull out handle panel, such that after closure of the waste container, the handle may be pulled out from the top panel to provide for relatively easy transport of the filled waste container. The container is fashioned from two integral paperboard blanks, with one blank forming an inner rectangular tube type container fitting telescopically into and being shorter than, an outer rectangular container, the latter formed from the other of the two integral blanks.

In one form of the invention, the inner container is spaced from the sides and bottom of the outer container. This construction produces a gap between the inner and outer containers and, while slightly reducing the volumetric capacity, serves to inhibit sharp objects such as syringes from piercing the bottom and outermost sides of the waste container to such an extent that sharp tips project from the container and possibly puncture the skin of waste disposal personnel handling the filled containers.

A plastic bag may be placed around, or within, the inner container to maintain waste liquids therein, as is conventional in this art. Further, which not the preferred form of the invention, the tube type inner container may be omitted, while retaining the plastic bag within the outer rectangular container to inhibit escape of waste liquids.

According to another form of the invention, the pull out handle is omitted and instead a pair of hand receiving openings are provided at the upper portion of the container for the purpose of lifting the filled container. These openings communicate with the interior of a respective generally hollow rectangular beam, the arrangement being such that the fingers of the person moving the container, after it has been latched closed, are prevented from coming into contact with the container contents.

BRIEF DESCRIPTION OF THE DRAWINGS

FIG. 6 is a view taken along section 6—6 of FIG. 4.

FIG. 7 is a view taken along section 7—7 of FIG. 4.

DETAILED DESCRIPTION OF THE INVENTION

Figure 1:
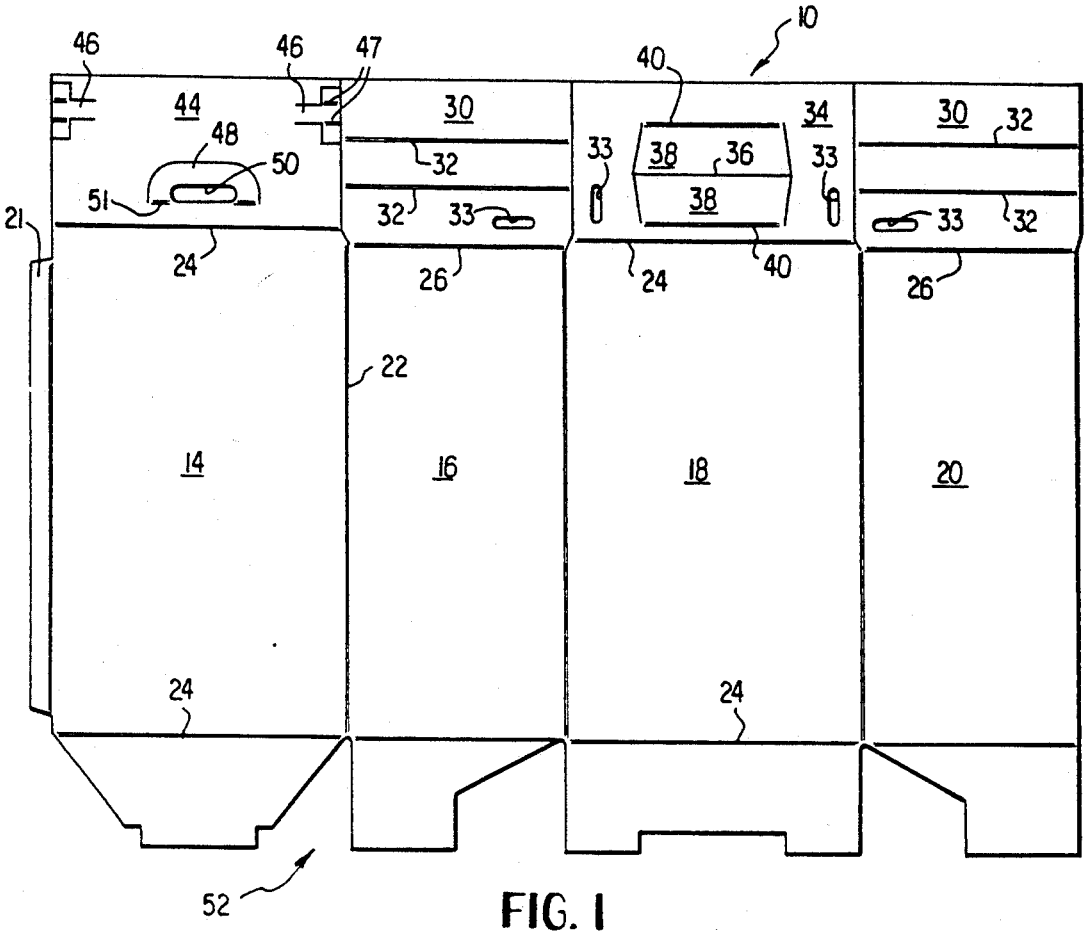
FIG. 1 is a plan view of a unitary blank of paperboard for forming the outer container of the receptacle of this invention.

Referring now to FIG. 1 of the drawings, the numeral 10 denotes generally a unitary blank fashioned from paperboard or corrugated paperboard or other stiff, resilient and foldable sheet material. Because it is easily biodegradable, paperboard or corrugated paperboard is the preferred material of construction. The numerals 14 and 18 denote front and rear sidewall panels, while the numeral 16 and 18 denote end wall panels. Vertically extending fold lines are denoted as 22, while horizontally extending fold lines are denoted as 24 and 26. Panels, 14, 16, 18, and 20 are serially arranged side by side and each of them may be considered as a side wall forming panel. Side wall panels 16 and 20 are each provided at their upper portions with panels 30, each panel 30 having a pair of parallel fold lines 32. Each panel 30 is also provided with latch openings 33 being identical in shape, here shown as generally rectangular. Front side wall 1B is provided at its upper end with flap 34, flap 34 being foldably secured to panel 18 by fold line 24, just as horizontal fold line 26 joins panel 30 to side wall panel 20. It will be observed that fold lines 24 and 26 are not colinear. Panel 34 is provided with a cut line 36, cut line 36 defining trap door like mouth or opening forming flaps 38, the latter foldably secured to panel 34 by fold lines 40. The ends of flaps 38 are oppositely tapered. Panel 34 is also provided with generally rectangular latch openings 33 on either side of the mouth flaps.

Side wall panel 14 is provided as upper portion with panel 44, joined thereto by fold line 24. Panel 44 includes generally T-shaped latching tabs 46 defined by the indicated cut lines which assume the general shape of a T. It will be observed that each latch tab or member 46 includes a pair of spaced, short, horizontally extending fold lines 47. Panel 44 is also provided with cut lines defining a handle 48, the handle having a finger receiving recess 50, the handle pivotally secured in the plane of panel 48 by horizontal fold lines 51. Handle 48 is adapted to be bent out of the plane of panel 44, as will later be explained. A manufacturer's flap 21 is carried by panel 14.

Panels 30 are adapted to form triangular girders, as will later be explained, with panel 34 termed an inner closure panel and panel 44 termed an outer closure panel.

The bottom of each of panels 14, 16, 18, and 20 is provided with a respective bottom closure panel, these bottom closure panels denoted generally by the numeral 52 for forming a closure, with the exact shape and number of panels 52 not being relevant to this invention. Preferably, panel 14 carries the customary manufacturer's flap designated as 21.

Figure 2:
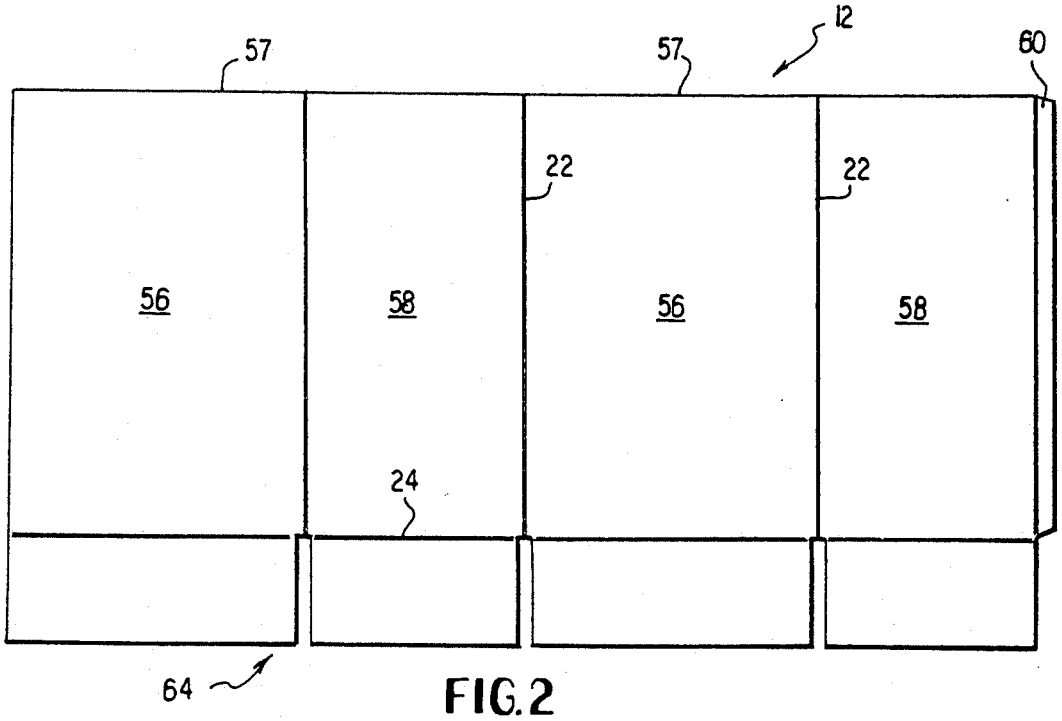
FIG. 2 is a plan view of a unitary paperboard blank for forming the inner container of the waste receptacle of this invention.

Referring now to FIG. 2 of the drawings, the numeral 12 denotes a unitary blank of paperboard, corrugated paperboard, or other stiff, resilient, and foldable sheet material. Panels 56 are slightly narrower than corresponding panels 14 and 18 of FIG. 1, while panels 58 are slightly narrower than corresponding panels 16 and 20. One of the panels 58 carries the usual manufacturer's flap denoted as 60. Bottom closure forming panels are secured to each of the panels 56 and 58 and are designated generally as 64, with the exact shape and number of the bottom closure panels not relevant to this invention.

Figure 3:
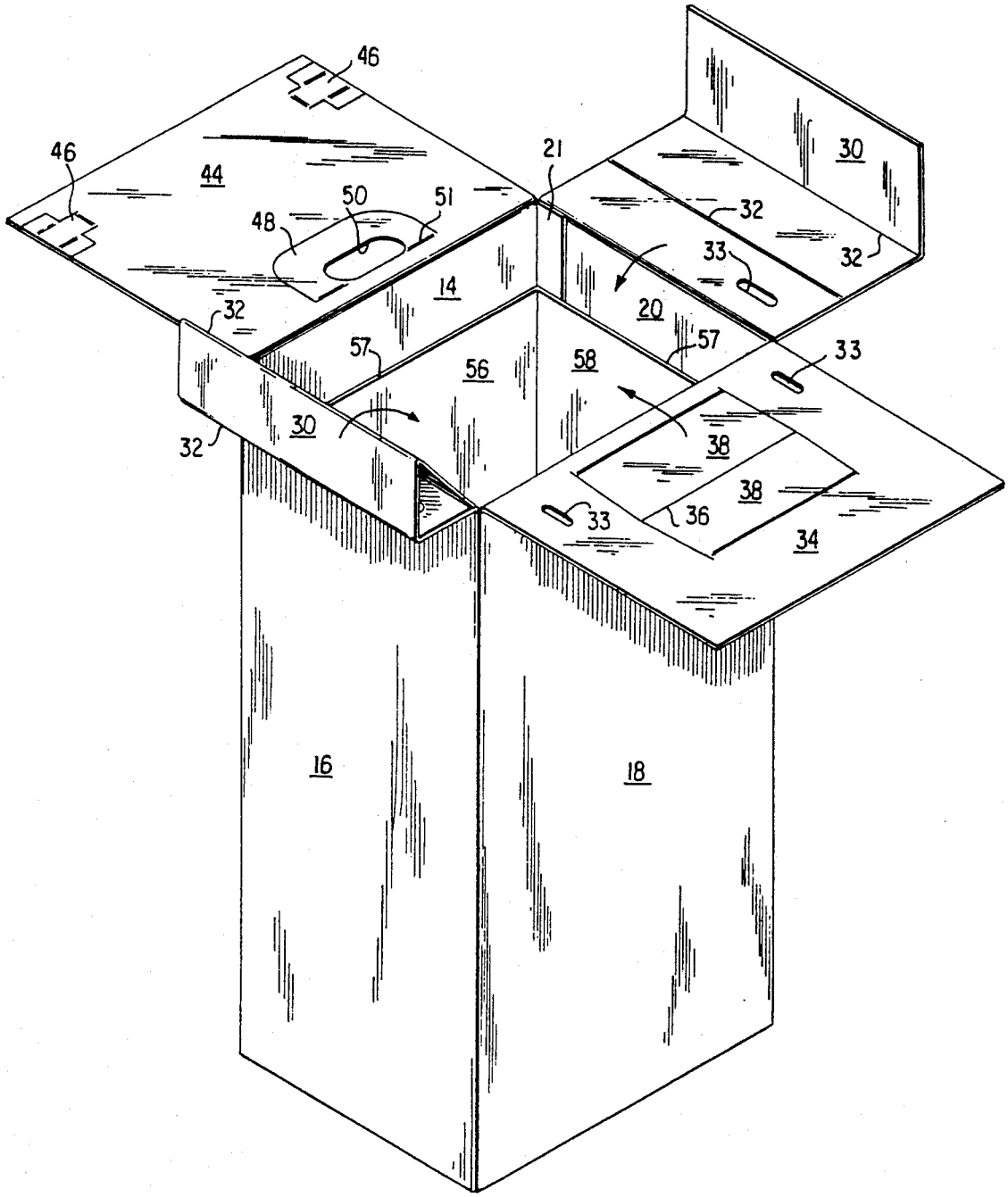
FIG. 3 is a perspective view illustrating the two containers of FIGS. 1 and 2 as assembled, with the outer container being opened.

Referring now to FIG. 3 of the drawings, an inner container has been formed from the blank of FIG. 2 by folding the panels of blank 12 and gluing the manufacturer's flap, and forming the bottom closure from panels 64. Similarly, an outer container has been formed from the blank of FIG. 10 by folding the panels, securing the manufacturer's flap 21 and forming the bottom from panels 52. The inner container is open ended, while the outer container includes flaps 30, 34 and 44 at its upper portion. Both containers are in the general form of a rectangular parallelepiped.

As indicated at the upper left portion of FIG. 3, one of the panel pairs 30, 30 has been folded about its lines 32 to form a girder having a generally triangular transverse cross section. The opposite panel 30 has been partially folded so as to assume this same form. With continued rotation of the already folded panel 30 in a clockwise direction, as indicated by the curved arrow, one edge of this girder will rest, at two spaced portions, on the upper rim of opposite panels 56 of the inner container. This contact is also indicated at FIG. 6.

Figure 4:
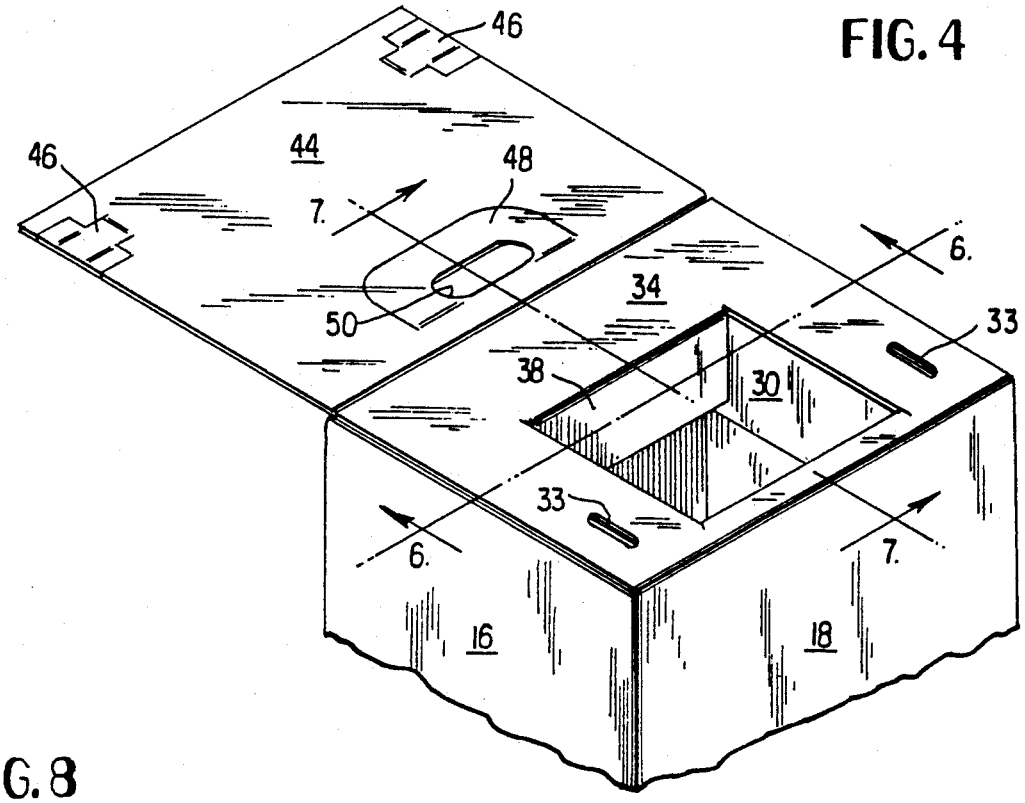
FIG. 4 is a perspective view showing three of the four upper, outer container flaps of FIG. 3 folded to partially close the upper portion of the receptacle of this invention.
Figure 8:
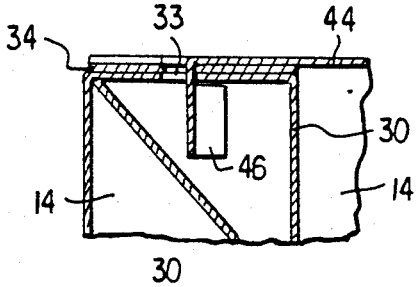
FIG. 8 is a view taken along section 8—8 of FIG. 5.
Figure 5:
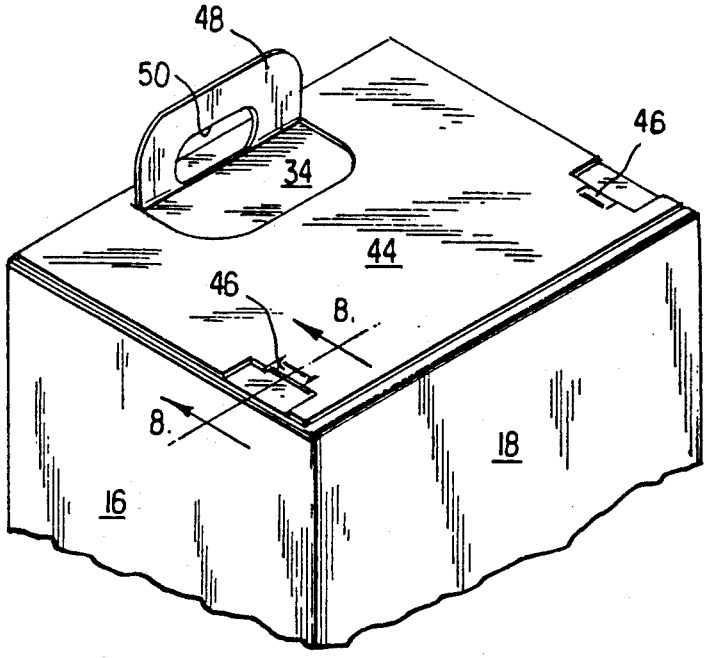
FIG. 5 is a partial perspective view of the upper portion of the receptacle of this invention after the outer flap of FIG. 4 has been closed and the receptacle unreleasably fastened together.

Referring now to FIG. 4, both panels 30 have been folded to assume generally triangular girders and inner closure panel 34 has been folded in the direction of the curved arrow counter clockwise so as to rest on the flat surfaces defined by the two triangular girder panels, also as shown at FIG. 6. Next, mouth flaps 38 are pushed downwardly, with one of the flaps 38 indicated at FIG. 4. The relation between the elements is such that the mouth flap panels 38, at their tapered ends, frictionally engage a surface of a respective girder panel formed from flaps 30. FIGS. 4 and 6 show that top edge or rim 57 of the inner container supports edges of the girders. FIG. 4 illustrates the hospital waste receptacle of this invention when in use in a hospital. Hospital waste is deposited in the open mouth of the receptacle After the receptacle is filled, outer top closure panel 34 is rotated clockwise from the position shown at FIG. 4 to the position shown at FIG. 5. At this time, T-shaped latch elements 46 are bent out of the plane of panel 44, with their tips folded substantially 180 degrees with each tip inserted into respective aligned latching slots 33 in flaps 30 and inner closure panel 34. Due to natural resiliency of the corrugated paperboard or other sheet material, the bent ends of T-shaped latching elements 46 spread apart towards their original position in panel 44, as indicated at FIG. 8, to form a latch. Thus, after such folding and latching, the contents of the waste receptacle are prevented from coming out of the receptacle by inadvertent unlatching of outer panel 44. Handle panel 48 is raised, as indicated at FIG. 5, so as to provide a convenient method of lifting and carrying the receptacle to an intermediate or final waste storage area.

Referring now to FIGS. 9–12 of the drawings, a second embodiment of the invention will now be described wherein the side walls of the inner container are spaced from the side walls of the outer container, and wherein the bottom of the inner container is spaced from the bottom of the outer container.

Figure 9:
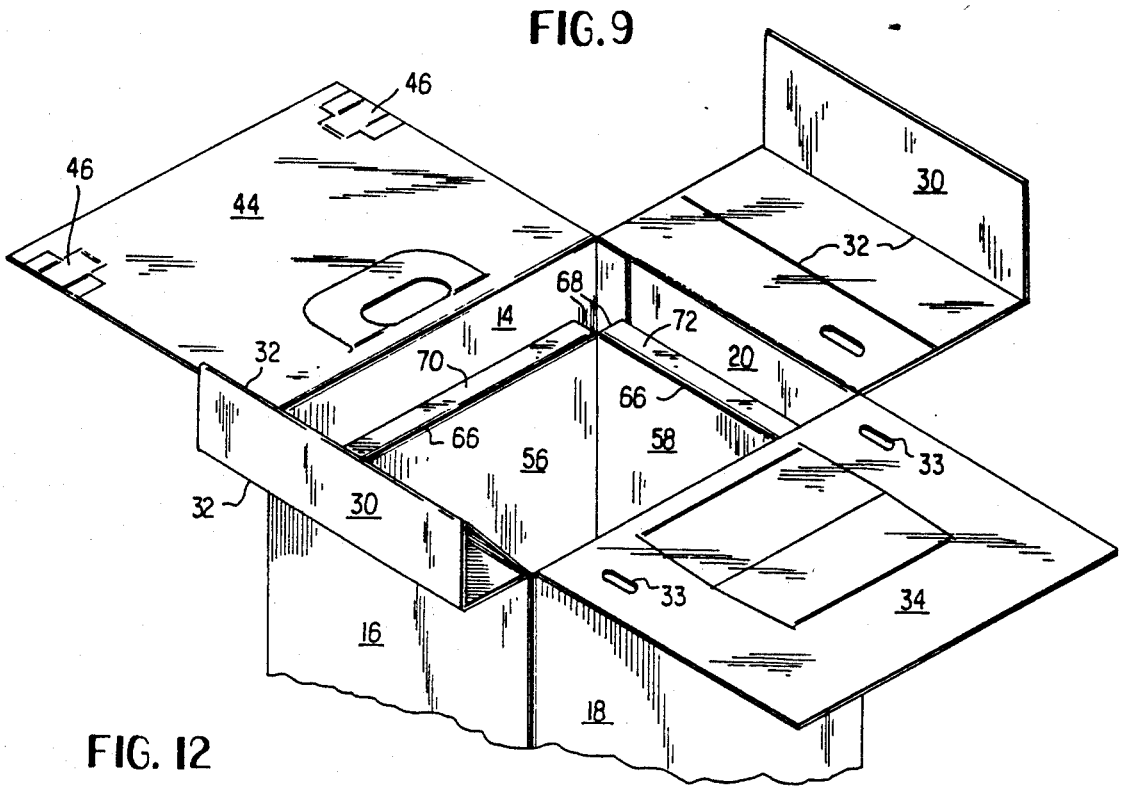
FIG. 9 is a partial perspective view, similar to FIG. 3, showing a second embodiment of the invention wherein the inner container is spaced from both the side walls and the bottom wall of the outer container.

FIG. 9, similar to the upper portion of FIG. 3, illustrates this second embodiment and the reader will observe that the construction of the outer container is identical to that previously described. Here however, the side walls 56, 58 of the inner container are provided at their upper portions with respective outwardly extending spacer flanges 70 and 72. These flanges extend radially outwardly at an angle of about 90 degrees with respect to their respective side walls to which they are integrally foldably attached.

Figure 12:
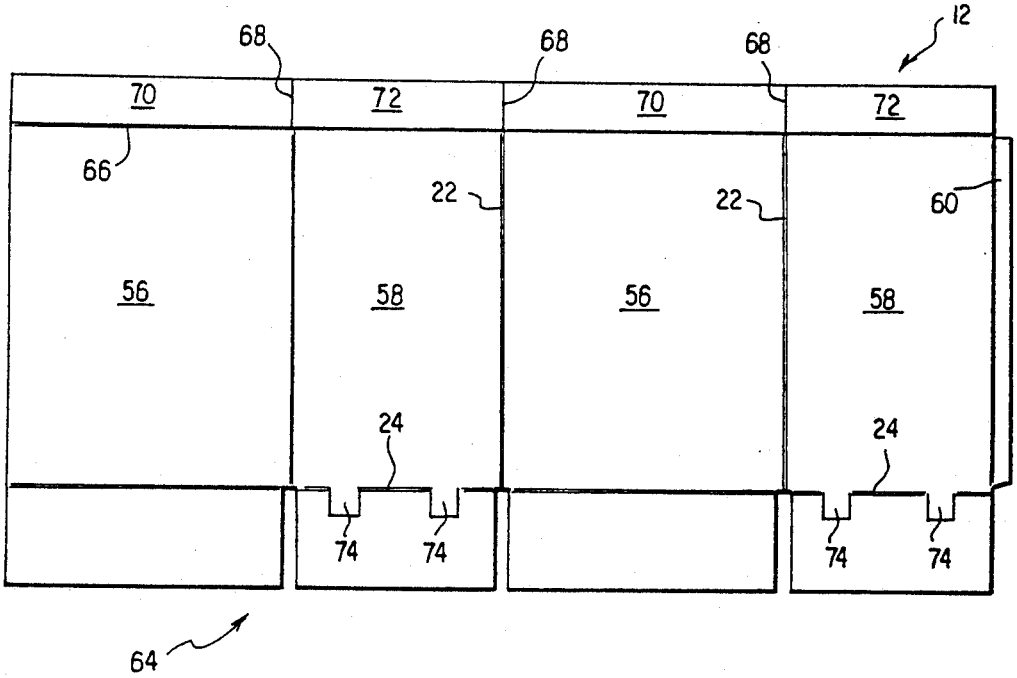
FIG. 12 is a view, similar to FIG. 2, and illustrates a blank for the formation of the inner container according to the second embodiment of this invention.
Figure 10:
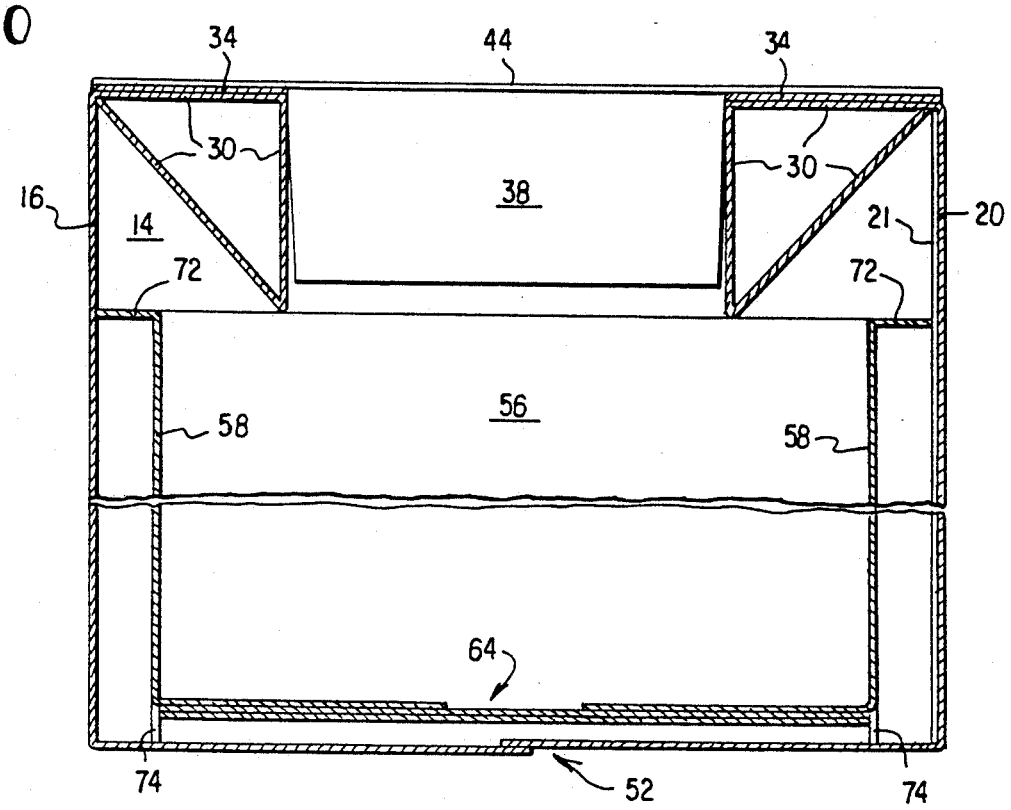
FIG. 10 is a view, similar to FIG. 6, of the second embodiment of this invention.
Figure 11:
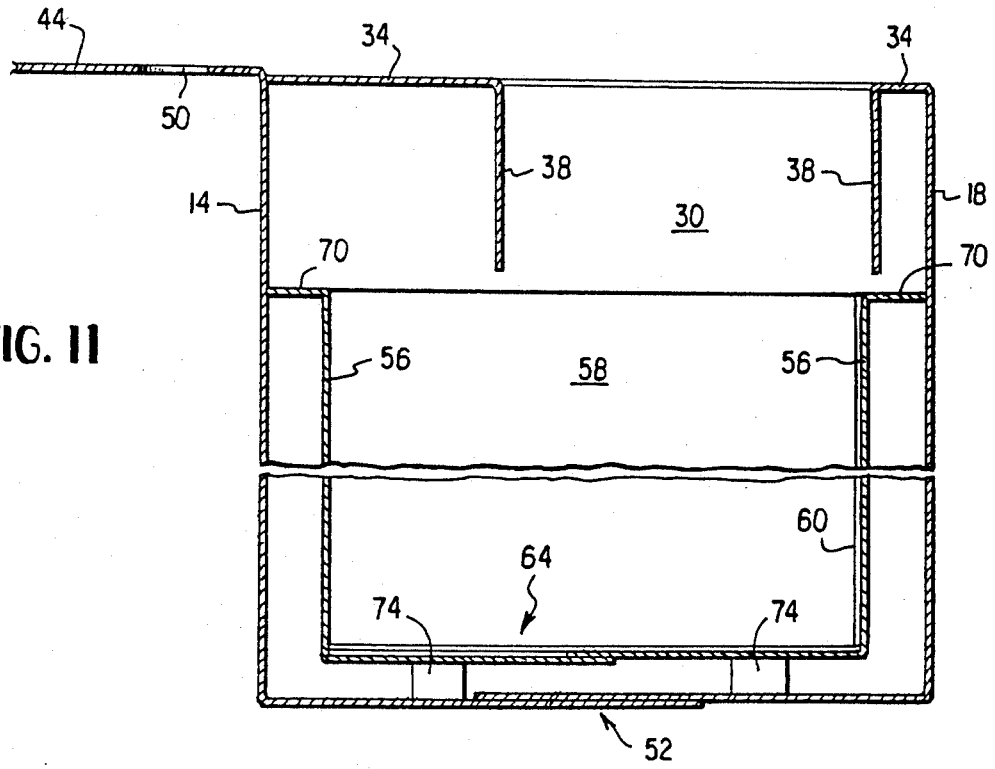
FIG. 11 is a view, similar to FIG. 7, of the second embodiment of this invention.

FIGS. 10 and 11 further illustrate that the upper portions of each of the four sides 56, 58, of the inner container is provided at its upper portion with a radially outwardly extending flange. Width panels 58 each carry a respective upper flange 72, while longitudinal panels 56 each carry a respective upper flange 70. An uppermost fold line 66 extends horizontally across the top of blank 12, as indicated at FIG. 12, with cut lines 68 extending from the upper free edge of the blank down to hinge or fold line 66. Further at FIG. 12, the reader will observe that cut lines at the bottom of panels 58 define a plurality of push out spacer tabs 74, of generally rectangular configuration, with these tabs serving as bottom spacers.

FIGS. 10 and 11 also show that each of the four side walls is provided with a respectively outwardly extending spacer flange 70, 72, with the free edge of each of these flanges contacting the inner surface of the outer container. FIGS. 10 and 11 illustrate the spacer function of push out tabs 74, with these tabs spacing bottom closure 64 of the inner container upwardly from bottom closure 52 of the outer container.

The function of this second embodiment is to further inhibit risk of injury to personnel handling filled waste containers of this invention from skin punctures or skin abrasions by sharp objects, such as syringes, which might accidentally pierce both the inner and outer walls of the waste receptacle of this invention. By spacing the inner walls 56, 58 from the outer walls of the container, there is a greater probability that a syringe, for example, will abut the interior surface of the inner container, to thereby stop its movement, and inhibit the accidental puncture by the needle of the syringe of the walls of the outer container. The same is true for scalpels or other sharp objects which may, under the weight of waste material above it, tend to puncture the outer walls of the waste receptacle.

If desired, the inner container of either embodiment may be omitted. The outer container, formed from the blank of FIG. 1, is erected and used in the same manner as previously described.

Figure 13:
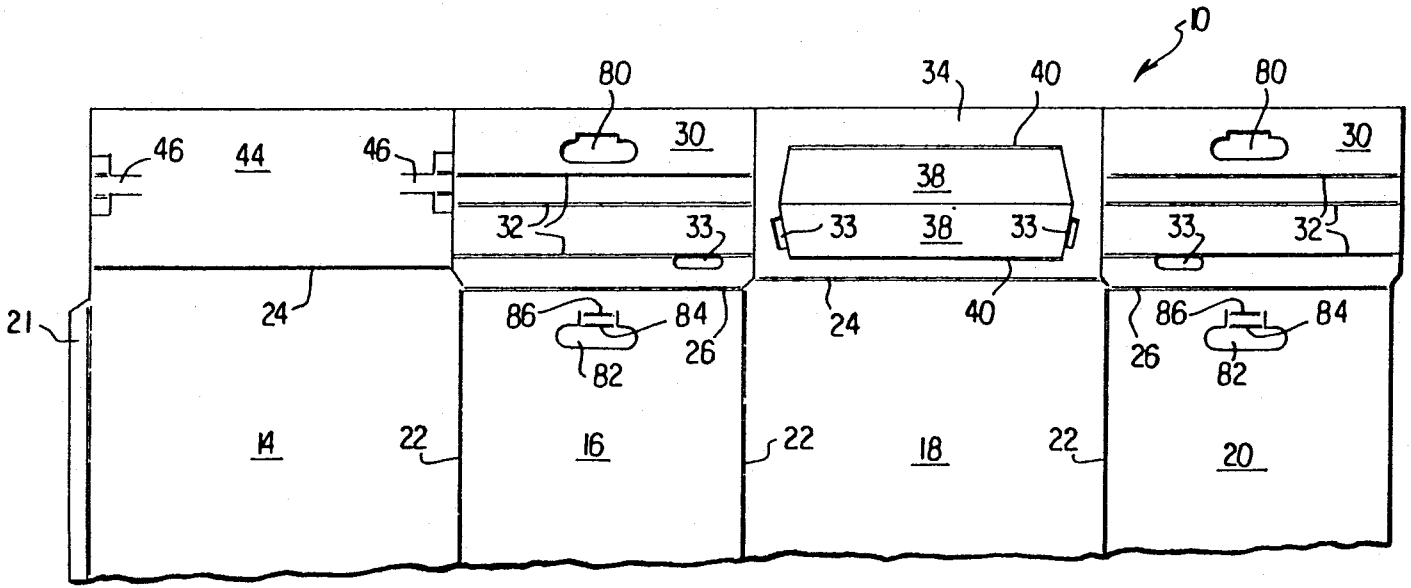
FIG. 13 is a plan view of the upper portion of a blank of a modified version of the container of this invention.

Referring now of FIGS. 13-20 of the drawings, a third embodiment of the invention is illustrated which employs many of the structural features of the first and second embodiments. Referring to FIG. 13, the upper portion of a blank for forming the outer container is shown, the blank being similar to that illustrated at FIG. 1. Where the elements of the embodiments previously described and this embodiment are the same, the same reference numerals are employed. Thus, numerals 14, 16, 18, and 20 again represent generally rectangular paperboard panels in the unitary blank 10. The reader will observe that left or uppermost closure panel 44 does not include a fold out handle 48. Otherwise, upper panel 44 is similar to that shown at FIG. 1 and includes latch tabs or means 46.

Both end panels 30 are provided with a cutout 80 to define one portion of respective hand receiving openings. Panels 30 are provided with three horizontal fold lines 32, and a respective opening 33 which defines a portion of a latch means. Panel 34 is again provided with a pair of trap door like panels 38, each pivoted about a respective pivot or fold axis 40. Latch defining openings or means 33 are located at both ends of the lower trap door like panel 38.

Panels 16 and 20 are provided with respective hand hole tongues 82 foldable about fold lines 84 and 86.

Figure 14:
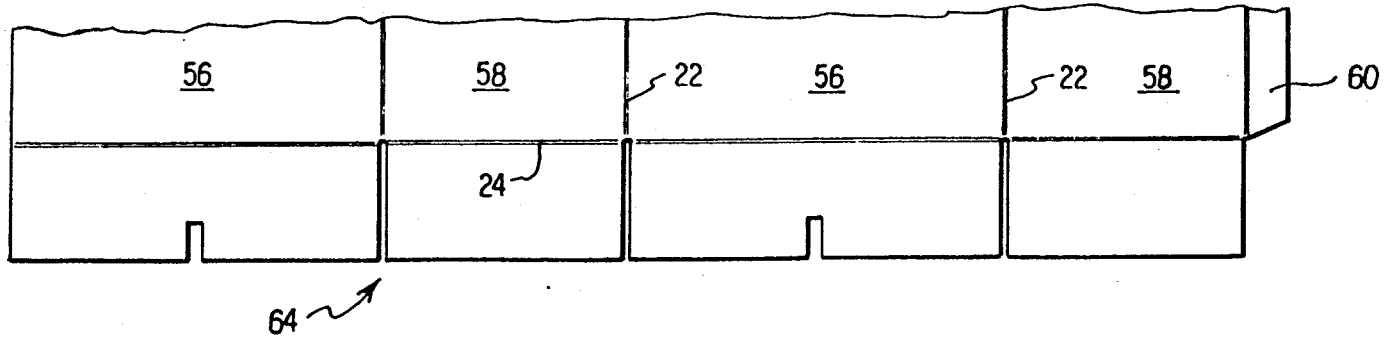
FIG. 14 is a plan view of a portion of the bottom of a blank used for making an internal container, being similar to the blank shown at FIG. 2.

Referring now to FIG. 14, the lower portion of a blank 12 for forming an inner container is illustrated, the blank being similar to that shown at FIG. 2 of the drawings. The vertical slots in those bottom forming panels 64 beneath panels 56 permit the free edges of the former to be partially interlocked upon setup of the inner container from the blank.

Figure 15:
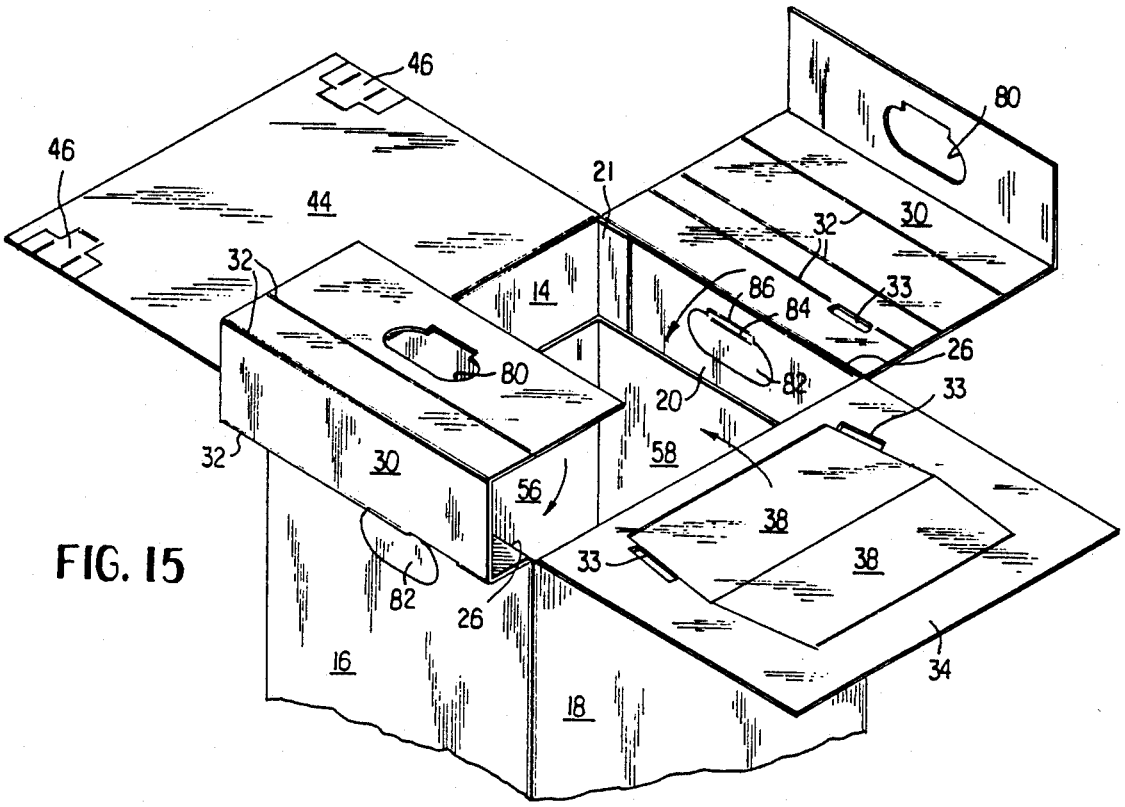
FIG. 15 is a partial perspective view, similar to FIG. 3, illustrating a step in the formation of the container.
Figure 16:
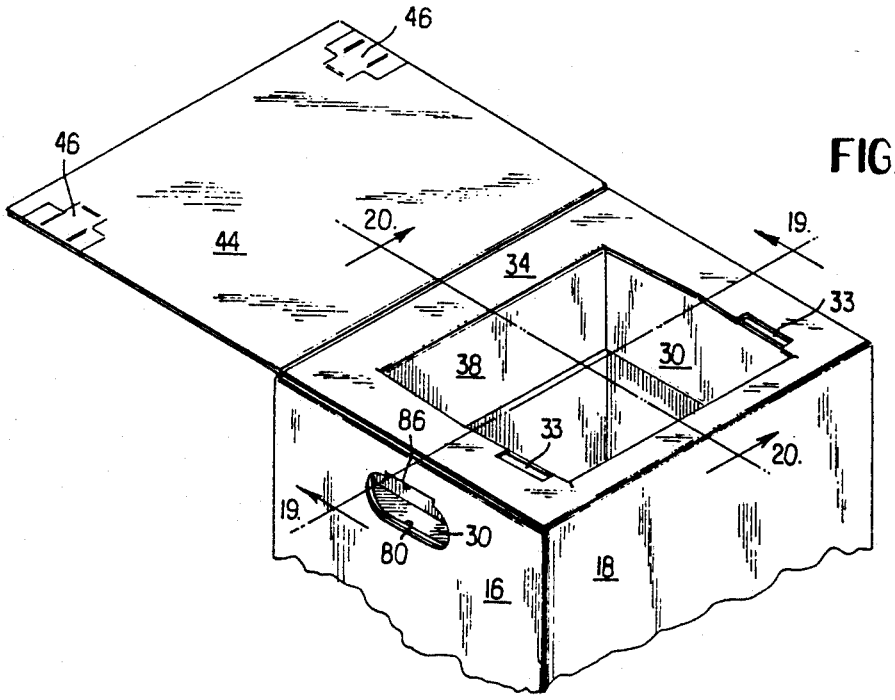
FIG. 16 is a partial perspective view, similar to FIG. 4 of the first described embodiment, showing a later stage in the formation of the container of this invention.
Figure 19:
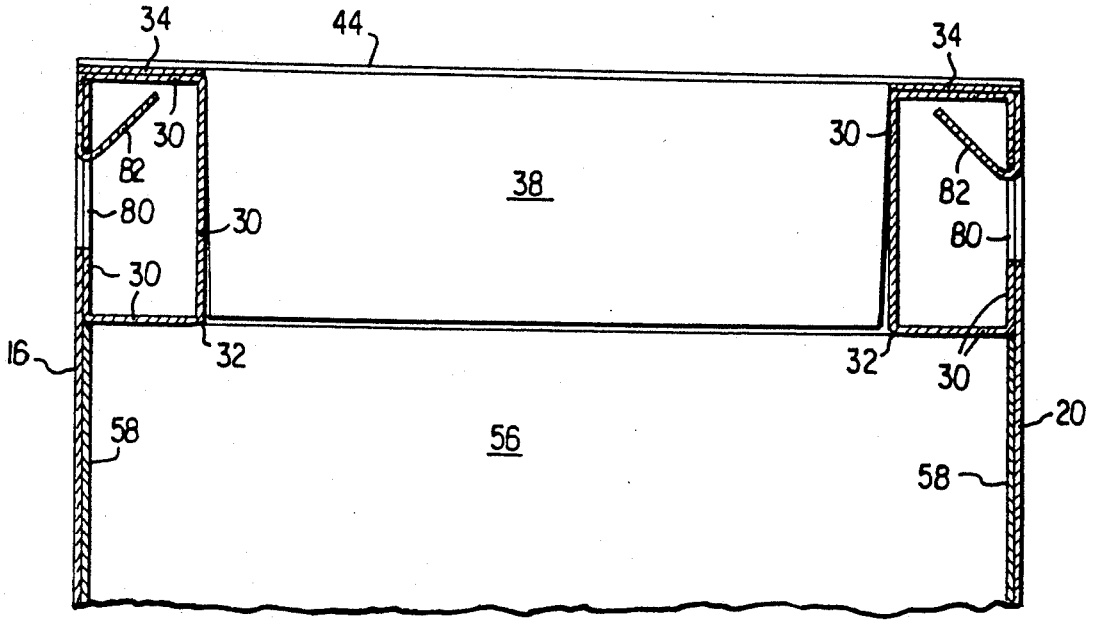
FIG. 19 is a view taken along section 19—19 of FIG. 16.

Referring now to FIG. 15, the several side forming walls of blank of FIG. 13 have been bent about vertically extending fold lines 22, and manufacturer's flap 21 has been glued to the free right hand edge of panel 20 to form a generally rectangular tube. The bottom of the tube is closed by means of bottom forming panels (not shown) on the blank of FIG. 13, similar to those denoted as 52 at FIG. 1. The bottom of the tube receives the inner container whose blank is shown at FIG. 14. End panels 30 are folded about their respective fold lines 32 and 26 as indicated at FIG. 15, with lowermost closure panel 34 and uppermost closure panel 44 in the positions indicated. Next, as shown at FIG. 16, each of the end panels 30 is folded to define a generally hollow beam or girder, rectangular in transverse cross-section, with a bottom portion of each beam resting on a portion of the top edge of innermost container 58, as may be seen at FIG. 19. As shown at FIGS. 16 and 19, tongues 82 are folded inwardly upwardly against a rim portion of respective openings 80 to define a pair of opposite hand holes, each for a respective rectangular beam member, and surrounded by two thicknesses of the paperboard. Innermost top closure panel 34 has been folded as indicated by the curved arrows at FIG. 15 so as to overlie the top of the rectangular tube. Each trap door like panel 38 is folded downwardly to a position approximately 90 degrees with respect to its mother panel 34. Both trap door like panels 38 and portions of respective panels, 30 which form the rectangular hollow beams, meet at right angles.

Figure 17:
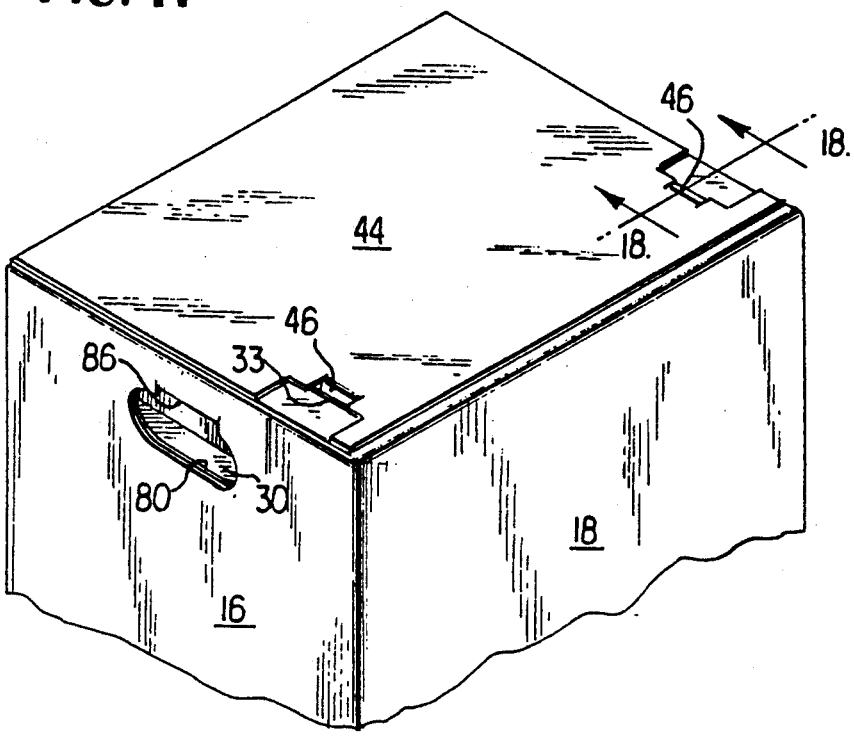
FIG. 17 is a partial perspective view, similar to FIG. 5, and shows the container in its fully closed position.
Figure 18:
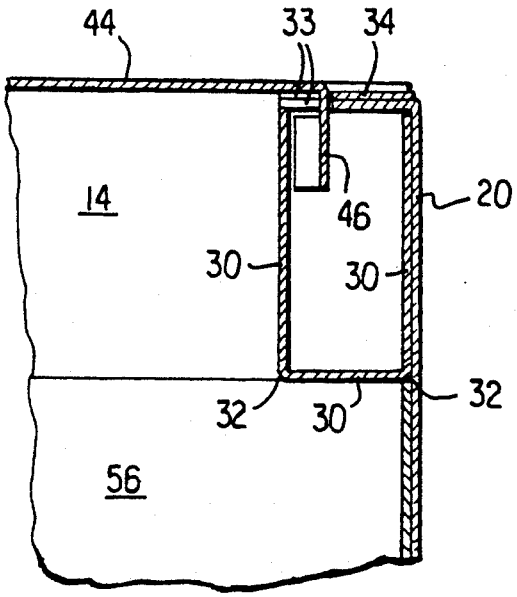
FIG. 18 is a view taken along section 18—18 of FIG. 17.

FIG. 17 shows that uppermost closure panel 44 has been folded to the right, with latching means or tabs 46 inserted into latching openings or means 33 to firmly and essentially unreleasably latch uppermost closure panel 44 in its closed position. This latching action is shown in detail at FIG. 18.

Figure 20:
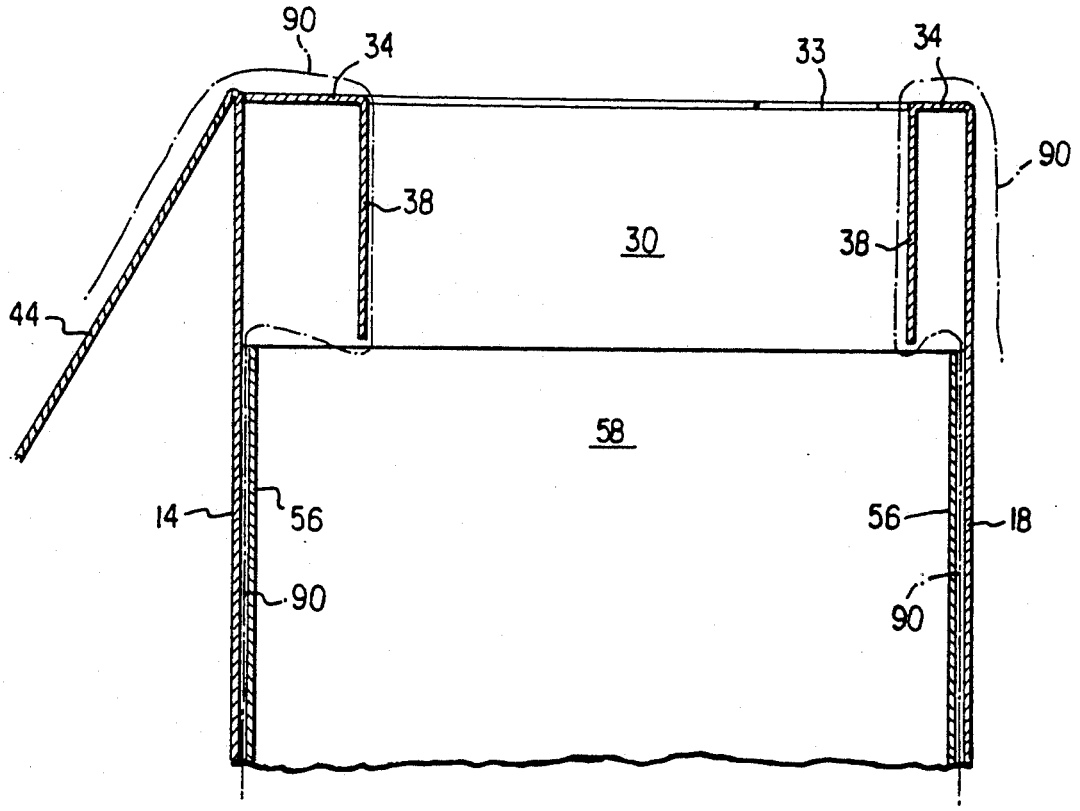
FIG. 20 is a view taken along section 20—20 of FIG. 16.

FIG. 20 illustrates a preferred component for use with the container of the invention and is defined by a plastic bag denoted by dashed lines and designated as 90. This plastic bag is similar to the common plastic trash or leaf bags. The bag is placed on the exterior surfaces of innermost container 58, whose bottom is closed by folding and gluing bottom forming panels 64 of FIG. 14, with the top of the bag extending against all four sides of the opening defined by portions of the rectangular beams defined by panels 30 and trap door like panels 38. The lower and middle sides of the bag extend between opposite side walls of the inner and outer containers. The plastic bag may also be used with the first and second embodiments previously described.

FIG. 20 illustrates the use position or configuration of the container and its plastic bag, with hospital waste being dumped into the interior of the container from time to time until full. When full, the top of plastic bag 90 is gathered up and preferably tied and pushed down into the container. Then uppermost closure panel 44 is then closed and latched as shown at FIG. 17.

I claim:

1. A hospital waste receptacle of paperboard including inner and outer containers each having vertically extending side walls, the inner container having a top and fitting into the outer container and being shorter in height than the outer container, the inner container having a closed bottom and being open at its top, the outer container having a closed bottom the upper ends of each of said side walls of the outer container having a respective integral, foldable flap, each of an opposing pair of said flaps being folded to form a hollow beam, each said hollow beam being of substantially uniform transverse cross section, an inner top closure flap defined by another of said integral upper flaps of the outer container, said inner top closure flap having a generally central opening aligned with the inner container, an outer top closure flap defined by yet another of said integral upper flaps of the outer container, said outer closure flap resting on said inner closure flap, means to fasten the outer and inner top closure flaps together, said inner top closure flap opening being defined by at least one folded down flap, the edges of said folded down flap being tapered and frictionally engaging respective portions of said hollow beams.

2. The waste receptacle of claim 1 wherein said inner and outer containers are each of generally rectangular form having four said side walls.

3. The waste receptacle of claim 1 wherein said outer top closure flap is provided with means to lift and carry the receptacle.

4. The waste receptacle of claim 1 wherein said inner container telescopically fits into the outer container, with respective side walls of the inner and outer containers being in substantial surface to surface contact with each other.

5. The waste receptacle of claim 1 wherein said bottom of the inner container is in surface to contact with the bottom of the outer container.

6. The waste receptacle of claim 1 wherein said side walls of the inner container are spaced from respective said side walls of the outer container.

7. The waste receptacle of claim 6 wherein said inner container carries spacing flanges which abut said side walls of the outer container.

8. The waste receptacle of claim 1 wherein the bottom of the inner container is spaced from the bottom of the outer container.

9. The waste receptacle of claim 1 wherein each of said hollow beams presents a flat surface and wherein the inner top closure flap rests on said hollow beam flat surfaces.

10. The waste receptacle of claim 1 wherein each of said hollow beams is generally rectangular in transverse cross section.

11. The waste receptacle of claim 1 wherein each of said hollow beams is generally triangular in transverse cross section.

12. The waste receptacle of claim 1 including a flexible plastic bag, said bag having a closed bottom and sides, the bag bottom located between the bottom of said inner container and the bottom of said outer container, the bag sides extending upwardly and a portion of them located between the side walls of the inner container and a portion of the side walls of the outer container, the uppermost portion of said bag extending upwardly and located inwardly of said central opening of said inner top closure flap.

13. The waste receptacle of claim 10 wherein a portion of each of said hollow beams is parallel and contiguous to a respective portion of a respective side wall of said outer container, a hand hole opening through each of said hollow beam and side wall contiguous portions, to thereby define two opposite hand holes each formed of two thicknesses of paperboard.

14. The waste receptacle of claim 1 wherein a part of each of said hollow beams rests on a portion of the top of said inner container.

15. A unitary blank for forming a container for a hospital waste receptacle, the blank fashioned of paperboard and including a plurality of horizontally and vertically extending fold lines to define four serially arranged side wall forming panels each having a lower end and an upper portion, at least one of the side wall forming panels being provided at its lower end with a bottom closure panel, one of said side wall forming panels provided in its upper portion with a foldable inner top closure panel, said inner top closure panel having at least one trap door flap adapted to be bent out of said inner top closure panel to thereby create an opening therein, said trap door flap having opposite edges, said trap door flap opposite edges being tapered, said inner top closure panel also including means for forming a portion of a latch, side wall forming panels which are immediately next to the side wall forming panel provided with the inner closure panel provided at their respective upper portions with a foldable hollow beam forming panel, said hollow beam forming panel including a plurality of parallel fold lines to permit each said hollow beam forming panel to be folded to form a hollow beam, each said hollow beam forming panel also including means for forming a portion of a latch, one of said side wall forming panels being provided at its upper portion with a foldable outer top closure panel, said outer top closure panel provided with means for forming a portion of a latch.

16. The blank of claim 15 wherein said outer top closure panel is provided with means for forming a handle.

17. The blank of claim 15 wherein said foldable hollow beam forming panels and their respective side wall forming panels are provided with means to form a hand hole.

18. A hospital waste receptacle of paperboard including inner and outer containers each having vertically extending side walls, the inner container having a top and fitting into the outer container and being shorter in height than the outer container, the inner container having a closed bottom and being open at its top, the outer container having a closed bottom, the upper ends of each of said side walls of the outer container having a respective integral, foldable flap, each of an opposing pair of said flaps being folded to form a hollow beam, an inner top closure flap defined by another of said integral upper flaps of the outer container, said inner top closure flap having a generally central opening aligned with the inner container, an outer top closure flap defined by yet another of said integral upper flaps of the outer container, said outer closure flap resting on said inner closure together, said inner top closure flap opening being defined by at flap, means to fasten the outer and inner top closure flaps least one folded down flap, the edges of said folded down flap being tapered and frictionally engaging respective portions of said hollow beams, said side walls of the inner container ares spaced from respective said side walls of the outer container.

19. The waste receptacle of claim 18 wherein said inner container carries spacing flanges which abut said side walls of the outer container.

20. The waste receptacle of claim 18 wherein the bottom of the inner container is spaced from the bottom of the outer container.

21. The waste receptacle of claim 18 wherein each of said hollow beams is generally triangular in transverse cross section.

22. The waste receptacle of claim 18 including a flexible plastic bag, said bag having a closed bottom and sides, the bag bottom located between the bottom of said inner container and the bottom of said outer container, the bag sides extending upwardly and a portion of them located between the side walls of the inner container and a portion of the side walls of the outer container, the uppermost portion of said bag extending upwardly and located inwardly of said central opening of said inner top closure flap.

* * * * *